United States Patent [19]

Gerard et al.

[11] Patent Number: 4,527,094

[45] Date of Patent: Jul. 2, 1985

[54] ALTITUDE COMPENSATION FOR FREQUENCY AGILE MAGNETRON

[75] Inventors: William A. Gerard, Andover; Robert J. Foreman, Newbury, both of Mass.

[73] Assignee: Varian Associates, Inc., Palo Alto, Calif.

[21] Appl. No.: 435,176

[22] Filed: Oct. 19, 1982

[51] Int. Cl.[3] ..... H01J 25/50

[52] U.S. Cl. ..... 315/39.55; 315/39.59; 315/39.61; 315/39.77; 331/90; 333/232; 333/233

[58] Field of Search ..... 315/39.51, 39.55, 39.59, 315/39.61, 39.77; 331/90; 333/231, 232, 233, 235

[56] References Cited

U.S. PATENT DOCUMENTS

| | | | |
|---|---|---|---|
| 3,247,421 | 4/1966 | Backmark | 315/39.61 |
| 3,297,909 | 1/1967 | Foreman et al. | 315/39.59 |
| 3,343,106 | 9/1967 | Honeyball | 333/232 |
| 3,441,795 | 4/1969 | Hynes et al. | 315/39.61 |
| 3,478,246 | 11/1969 | Perkins et al. | 315/39.61 X |
| 3,564,340 | 2/1971 | Bahr | 315/39.61 |
| 3,590,313 | 6/1971 | Stoke | 315/39.61 |
| 3,599,035 | 8/1971 | Frerichs | 315/39.61 |
| 3,852,638 | 12/1974 | Stoke | 315/39.61 |
| 4,311,968 | 1/1982 | Pickering et al. | 315/39.61 |
| 4,313,091 | 1/1982 | Busacca et al. | 315/39.61 |

*Primary Examiner*—Saxfield Chatmon

*Attorney, Agent, or Firm*—Stanley Z. Cole; William R. McClellan

[57] ABSTRACT

A frequency agile magnetron employs an altitude compensation vacuum envelope external to the vacuum envelope of the magnetron. The tuning assembly of the magnetron includes a tuning plunger coupled through a first bellows assembly to one end of a tuning shaft. The tuning shaft is coupled at its opposite end through a second bellows assembly to the compensation vacuum envelope. When the two bellows assemblies are identical, atmospheric forces acting upon the tuning shaft are balanced at any altitude. Translation of the tuning assembly is provided by an actuator such as a linear motor coupled to the tuning shaft. Improved transfer of heat from the resonant cavity is provided.

24 Claims, 2 Drawing Figures

ALTITUDE COMPENSATION FOR FREQUENCY AGILE MAGNETRON

DESCRIPTION

Background of the Invention

This invention relates to tunable, resonant cavity devices and, more particularly, to tunable, resonant cavity devices wherein novel compensation for atmospheric pressure is provided.

Frequency agile magnetrons can be rapidly tuned over a given frequency range and are commonly used in radar systems for clutter reduction and as an electronic countermeasure against enemy jamming efforts. Such frequency agile magnetrons typically include a movable tuning plunger positioned within a vacuum envelope in a resonant cavity and a tuning actuator positioned outside the vacuum envelope of the magnetron tube. Actuator movement is coupled to the tuning plunger without breaking the vacuum in the tube. Bellows have typically been used to couple the motion of the actuator to the tuning plunger.

A single bellows can be used to externally control movement of the tuning plunger within the magnetron tube. The bellows is sealed at one end around an opening in the vacuum envelope of the tube and is sealed at the other end to a movable element which is coupled to the tuning plunger. A serious problem with this configuration is that atmospheric pressure urges the movable element into the vacuum envelope. The tuning actuator must exert a compensating force to provide the desired tuning plunger movement. Furthermore, frequency agile magnetrons are frequently used in airborne applications. The force on the movable member varies with altitude, thus making compensation for the force of atmosphere difficult.

U.S. Pat. No. 3,564,340 issued Feb. 16, 1971, to Bahr, discloses the use of a single bellows in a manually tuned magnetron. A frictional torque load is applied to a ball screw actuator to prevent inadvertent rotation of the ball screw by the force of atmosphere on the mechanism.

According to the prior art, a double bellows arrangement has been utilized to compensate for atmospheric pressure upon a magnetron tuning assembly. Bellows are coupled to opposite sides of a movable member. As the tuning assembly is moved, one of the bellows expands while the other bellows is compressed. Since the volume contained within the vacuum envelope remains constant, it is not necessary to overcome atmospheric pressure to move the tuning mechanism. See, for example, U.S. Pat. No. 3,852,638 issued Dec. 3, 1974, to Stoke, and U.S. Pat. No. 3,590,313 issued June 29, 1971, to Stoke.

While the double bellows arrangement provides generally satisfactory compensation for atmospheric pressure, it has certain disadvantages. Durihg operation of high power magnetrons, considerable heating of the tuning plunger occurs. Since the tube is a vacuum device, heat is transferred by conduction from the tuning plunger through plunger support members to the movable member associated with the bellows and then through the tuning shaft to housing members. In order to facilitate rapid movement of the tuning mechanism, the mass of the movable members is reduced as much as possible. However, this results in movable members with a relatively high thermal resistance. The presence of the double bellows necessitates longer support members between the tuning plunger and the movable member, thereby increasing thermal resistance. Furthermore, these longer support members are located within the vacuum envelope, thus precluding any cooling by convection. In practice, the double bellows arrangement has presented difficulties in transferring heat from the tuning plunger.

A further disadvantage of the double bellows arrangement arises from the fact that both bellows are part of the vacuum envelope of the magnetron tube and are subject to the yield problems of the tube. If the magnetron tube becomes defective during manufacturing or during operation, two relatively costly bellows are scrapped with the tube. In addition, any defect in the bellows assembly can cause the entire magnetron tube to be scrapped. Yet another disadvantage relates to the increased length of the magnetron tube when the double bellows configuration is used. In airborne applications, it is frequently desirable to minimize the length of the magnetron. In the double bellows configuration, the two bellows are coaxially mounted and add directly to the length of the tube.

It is an object of the present invention to provide a tunable, resonant cavity device having altitude compensation apparatus with enhanced thermal transfer characteristics.

It is another object of the present invention to provide a tunable, resonant cavity device having altitude compensation apparatus of reduced length.

It is yet another object of the present invention to provide altitude compensation apparatus for a tunable crossed field electron discharge device wherein the complexity of the altitude compensation apparatus associated with the vacuum envelope of the device is reduced.

SUMMARY OF THE INVENTION

According to the present invention, these and other objects and advantages are achieved in a tunable, resonant cavity device comprising a device vacuum envelope enclosing a sealed vacuum chamber, a resonant cavity located within the device vacuum envelope and tuning means for altering the resonant frequency of the cavity. The tuning means comprises a first deformable assembly for transmitting motion through the device vacuum envelope and a tuning plunger means positioned in the device vacuum envelope and coupled to the first deformable assembly. An actuating means is positioned outside the device vacuum envelope for moving the tuning plunger means. A tuning shaft means is coupled between the actuating means and the first deformable assembly. The tuning means further comprises compensation means positioned outside the device vacuum envelope and operative to exert a force on the tuning shaft means which opposes the force thereon resulting from atmospheric pressure upon the first deformable assembly. The compensation means includes a compensation vacuum envelope and a second deformable assembly coupled between the compensation vacuum envelope and the tuning shaft means, so as to vary the volume of the compensation vacuum envelope in response to movement of the tuning shaft means. The first and second deformable assemblies each typically include a movable member and a bellows sealed to the respective vacuum envelope. The tunable, resonant cavity device can be a crossed field electron discharge device such as a magnetron.

BRIEF DESCRIPTION OF THE DRAWINGS

For a better understanding of the present invention, together with other and further objects, advantages and capabilities thereof, reference may be had to the accompanying drawings which are incorporated herein by reference and in which.

DETAILED DESCRIPTION OF THE INVENTION

Figure 1:
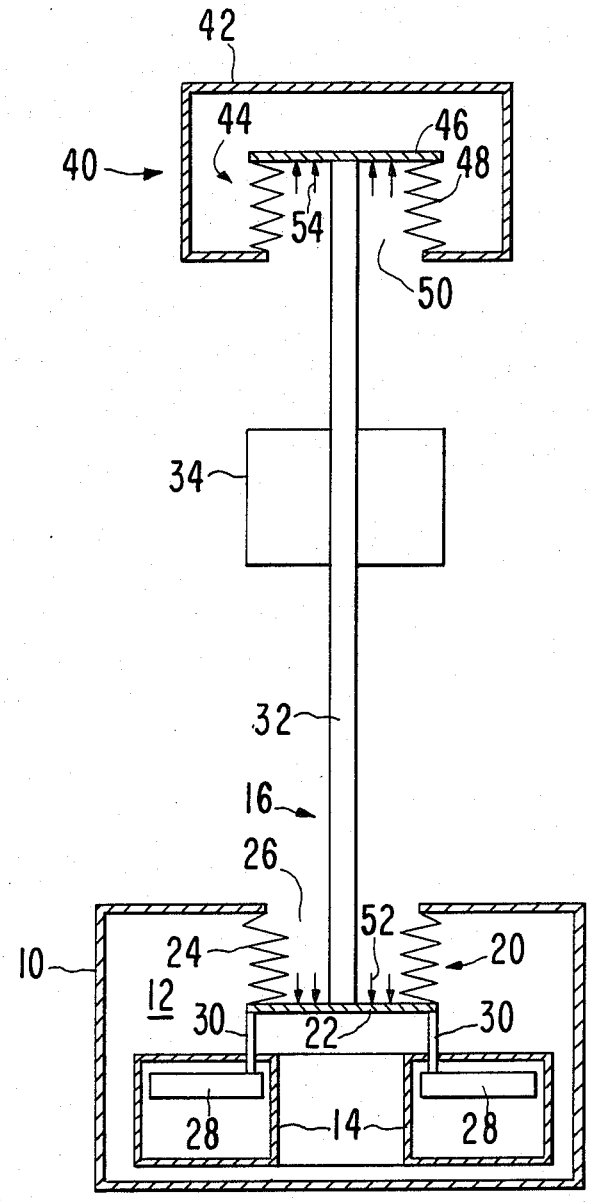
FIG. 1 is a schematic diagram illustrating the altitude compensation in accordance with the present invention.

A tunable, resonant cavity device in accordance with the present invention is illustrated schematically in FIG. 1. A device vacuum envelope 10 encloses a sealed vacuum chamber 12. Located within the device vacuum envelope 10 is a resonant cavity 14 which can be annular in shape. The resonant cavity 14 has an associated resonant frequency which can be altered by a tuning means indicated generally at 16.

The tuning means 16 includes a deformable assembly 20 comprising a first movable member 22 and a first bellows 24. One end of the bellows 24 is sealed around the inside edge of an opening 26 in the vacuum envelope 10. The other end of the bellows 24 is sealed around a prescribed area of the movable member 22. The movable member 22 and the bellows 24 in combination seal the opening 26. A tuning plunger 28 is positioned in the resonant cavity 14 and is coupled to the movable member 22 by support pins 30. In the present example, the tuning plunger 28 is generally annular in shape. The tuning means 16 further includes a tuning shaft 32 coupled at one end to the movable member 22 in the area surrounded by the bellows 24. The tuning shaft 32 is coupled to an actuating means 34 and, at its opposite end, is coupled to a compensation means 40. The compensation means 40 includes a compensation vacuum envelope 42 and a second deformable assembly 44, including a second movable member 46 and a second bellows 48. The second bellows 48 is sealed at one end around the inside edge of an opening 50 in the vacuum envelope 42. The other end of the bellows 48 is sealed around a prescribed area of the movable member 46 so that the deformable assembly 44 seals the opening 50 in the vacuum envelope 42. The tuning shaft 32 is coupled to the second movable member 46 in the area surrounded by the bellows 48.

In operation, the actuating means 34, which can be a linear motor, causes linear axial motion of the tuning shaft 32 which in turn causes movement of the tuning plunger 28 in the resonant cavity 14. The movement of the tuning plunger 28 causes a variation in the resonant frequency of the cavity 14. As the tuning shaft 32 and the first movable member 22 move upward or downward, the bellows 24 contracts or expands, thereby maintaining the seal on the vacuum envelope 10.

Atmospheric pressure exerts a force 52 on the movable member 22 in the direction indicated by the arrows in FIG. 1 and tends to force the same into the vacuum chamber 12. The force 52 is transmitted to the tuning shaft 32. Atmospheric pressure also exerts a force 54 upon the movable member 46 in the direction indicated by the arrows in FIG. 1. The force 54 is also transmitted to the tuning shaft 32 and opposes the force 52 and tends to compensate for atmospheric pressure upon the movable member 22. When the forces 52 and 54 are equal in magnitude, the tuning shaft 32 is in equilibrium and can easily be moved by the actuating means 34. As the tuning plunger 28 is moved downward, the bellows 24 is expanded, thereby decreasing the volume of the vacuum chamber 12 while the bellows 48 is compressed, thereby increasing the volume enclosed by the vacuum envelope 42. Similarly, as the tuning plunger 28 is moved upward, the bellows 24 is compressed, thereby increasing the volume of the vacuum chamber 12, while the bellows 48 is expanded, thereby decreasing the volume enclosed by the vacuum envelope 42. In a preferred embodiment, the area of the movable member 22 surrounded by the bellows 24 is equal to the area of the movable member 46 surrounded by the bellows 48. Also preferably, the bellows 24 and 48 are of the same design; that is, the same diameter, length and spring rate. When these conditions are met, the forces 52 and 54 are equal for any atmospheric pressure and compensation is accomplished. It will be realized by those skilled in the art that the compensation means 40 is not necessarily connected directly to the tuning shaft 32 but can be connected thereto by any suitable mechanical linkage.

Figure 2:
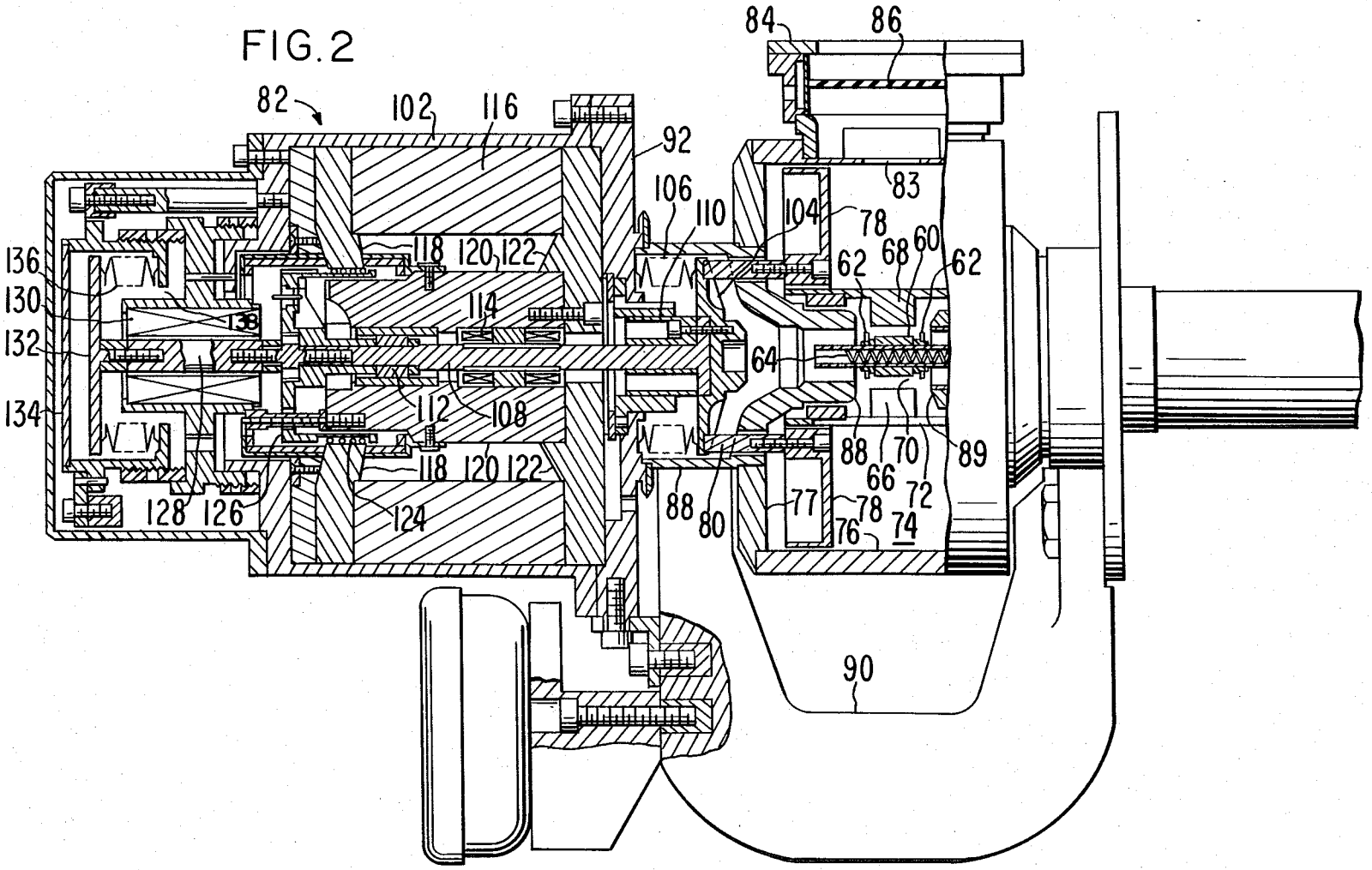
FIG. 2 is a cross-sectional view of a frequency agile magnetron in accordance with the present invention.

A cross-sectional view of a coaxial frequency agile magnetron is shown in FIG. 2. The magnetron has a cylindrical cathode emitter 60, such as tungsten impregnated with barium aluminate. At each end of emitter 60 is a projecting cathode end hat 62 of non-emitting material such as hafnium. The cathode is supported at one end on a cathode stem structure (not shown). The cathode emitter 60 is heated by a radiant heater 64 such as a coil of tungsten wire.

Surrounding emitter 60 is a coaxial circular array of anode vanes 66 extending inward from an anode shell 68. The inner ends of the vanes 66 lie on a cylinder defining the outer wall of a toroidal interaction space 70. The vanes 66 are regularly spaced circumferentially to define between adjacent vanes cavities resonant at approximately the desired frequency of oscillation.

On the outside wall of alternate cavities, axial slots 72 are cut through the anode shell 68 connecting with a coaxial toroidal stabilizing cavity 74 corresponding to the cavity 14 of FIG. 1. The cavity 74 includes walls 76, 77 which are preferably of copper to conductively cool the anode vanes 66 and to provide a high Q factor for frequency stabilization. The cavity 74 is tuned by an annular tuning plunger 78 which is axially movable by a plurality of push rods 80 driven in unison by a tuning assembly 82 described in detail hereinafter. The tuning plunger 78 corresponds to the tuning plunger 28 of FIG. 1 while the tuning assembly 82 corresponds generally to the tuning means 16 of FIG. 1. The cavity 74 is coupled by an iris 83 to an output waveguide 84 which is sealed off vacuum-tight by a dielectric window 86.

Axially displaced on opposite sides of emitter 60 and anode vanes 66 are coaxial ferromagnetic polepieces 88, 89. The polepieces 88, 89 are sealed to the tube body and are coupled to a permanent magnet 90. The permanent magnet 90 and the polepieces 88, 89 are configured to present opposite poles to opposite ends of the interaction space 70 and a generally uniform, generally axial magnetic field is produced in the interaction space 70.

A plate 92 seals one end of the magnetron and serves as a mounting plate for the tuning assembly 82. The vacuum envelope of the magnetron is thus formed by the walls 76, 77, the polepieces 88, 89, the dielectric window 86 and the plate 92. The tuning assembly 82 transmits motion through an opening in the plate 92 to the tuning plunger 78, as described hereinafter.

In operation of the magnetron shown in FIG. 2, ac heater current is supplied to the cathode heater 64 and the cathode is pulsed negative with respect to the grounded tube body and the anode vanes 66. Electrons are drawn from the cathode emitter 60 toward the vanes 66 and are directed by the crossed magnetic field into paths circulating around the toroidal interaction space 70, where they interact with fringing microwave electric fields of the inter-vane cavities and generate microwave energy. Microwave energy is coupled from the inter-vane cavities through the axial slots 72 to the stabilizing cavity 74. The circular electric mode of the cavity 74 locks the frequency of the pi mode of the excited anode vanes 66 to the resonant frequency of the cavity 74. Thus, when the resonant frequency of the stabilizing cavity 74 is altered by movement of the tuning plunger 78, the frequency of operation of the magnetron is likewise altered.

Referring again to FIG. 2, the tuning assembly 82 includes a housing 102 mounted to the plate 92 and is coaxially positioned with respect to the magnetron vacuum envelope. The tuning assembly 82 is operative to rapidly move the tuning plunger 78 as desired and thereby alter the resonant frequency of the stabilizing cavity 74. The tuning plunger 78 is coupled by the push rods 80 through openings in the polepieces 88 to a generally circular first movable member 104 corresponding to the movable member 22 of FIG. 1. One end of a first bellows 106, which corresponds to the bellows 24 of FIG. 1, is sealed around the inside edge of the opening in the plate 92. The other end of the bellows 106 is sealed around the periphery of the movable member 104. The movable member 104 and the bellows 106 in combination seal the opening in the magnetron vacuum envelope while providing the ability to transmit movement therethrough. Coupled to the center of the movable member 104 is an elongated tuning shaft 108 which is constrained to coaxial linear movement by linear bearings 110, 112. The tuning shaft 108 corresponds to the tuning shaft 32 of FIG. 1. The tuning shaft 108 passes through a linear velocity transducer 114 which is operative to sense the velocity thereof and through a linear motor, corresponding to the actuating means 34 of FIG. 1, which actuates linear coaxial movement of the tuning shaft 108. The linear motor includes a fixed position, coaxial motor magnet 116 and fixed position ferromagnetic polepieces 118, 120, 122 which complete the magnetic circuit. The linear motor further includes a coil 124 wound on a coil form 126 which is coaxial with and attached to the tuning shaft 108.

The end of the tuning shaft 108 opposite the movable member 104 is axially attached to one end of a magnetic element 128. The magnetic element 128 forms the core of a linear variable differential transformer 130 which is operative to sense the position of the tuning shaft 108. The other end of the magnetic element 128 is coupled to the center of a second movable member 132, which is positioned in a compensation vacuum envelope 134. A second bellows 136 has one end sealed around the periphery of an opening 138 in the vacuum envelope 134. The other end of the bellows 136 is sealed around the periphery of the movable member 132. The movable member 132, the compensation vacuum envelope 134 and the second bellows 136 correspond to the movable member 46, the vacuum envelope 42 and the bellows 48, respectively, of FIG. 1. The movable member 132 and the bellows 136 in combination seal the vacuum envelope 134 and permit the motion of the tuning shaft 108 to vary the volume enclosed by the vacuum envelope 134.

In operation, predetermined frequency tuning signals are applied to the input of the linear motor. The tuning signal may, for example be sinusoidal. The linear motor causes the tuning shaft 108 and the tuning plunger 78 to move axially in response to the input tuning signal. The frequency of the magnetron is thus varied, in accordance with the input tuning signals. The linear variable differential transformer 130 senses the position of the tuning shaft 108 while the linear velocity transducer 114 senses the velocity of the tuning shaft 108. From the position and velocity of the tuning shaft 108 can be derived the frequency and rate of change of frequency, respectively, of the magnetron. These parameters are utilized in an external processing system.

The vacuum envelope 134, the movable member 132, and the bellows 136 comprise a compensation means which compensate for atmospheric pressure upon the movable member 104. Atmospheric pressure exerts a force on the movable member 132 which opposes the force upon the movable member 104. Preferably, the area of the movable member 104 surrounded by the bellows 106 is equal to the area of the movable member 132 surrounded by the bellows 136, and the bellows 106 and 136 have equal diameters, equal lengths and equal spring rates. When these conditions are met, the atmospheric forces exerted upon the tuning shaft 108 are equal and opposite for any atmospheric pressure. Furthermore, the volume enclosed by the vacuum envelope 134 plus the volume within the vacuum envelope of the magnetron remains constant as the tuning plunger 78 is moved.

The configuration of FIG. 2 provides an excellent thermal transfer path from the tuning plunger 78 out of the tube to external heat sink members. Heat is transferred from the tuning plunger 78 through the relatively short push rods 80 directly to the movable member 104 and the tuning shaft 108. Heat is easily transferred from these members to the relatively massive housing members. Furthermore, the movable member 104 and the tuning shaft 108 are both exposed to atmosphere, thereby enhancing convective heat transfer. Prior art double bellows systems have employed a considerably more tortuous heat transfer path. Excessive heating of the magnetron can cause frequency drift and errors in the system operation. The configuration of FIG. 2 employs only one bellows 106 associated with the vacuum envelope of the magnetron. Therefore, in the event of magnetron failure during manufacturing or operation, a simpler and less expensive single bellows assembly is scrapped.

In the compensation means illustrated in FIG. 2, the movable member 132 and the bellows 136 are inverted into the vacuum envelope 134. The depth of the vacuum envelope 134 is only required to be sufficient to avoid contact between the envelope 134 and the movable member 132 at the maximum excursion of the tuning plunger 108. Therefore, the contribution by the compensation means to the overall length of the tube assembly is minimal. In prior art double bellows configurations, the length of the second bellows added directly to the length of the tube. It is further noted that in the configuration of FIG. 2, equal and opposite forces are applied to the ends of the tuning shaft 108. Therefore, all threaded connections associated with the tuning shaft 108 are placed under a constant tension regardless of the position of the tuning shaft 108. The constant tension is advantageous in preventing loosening of the various elements of the tuning mechanism during rapid movement.

While there has been shown and described what is at present considered the preferred embodiment of the invention, it will be obvious to those skilled in the art that various changes and modifications may be made therein without departing from the scope of the invention as defined by the appended claims.

What is claimed is:

1. A tunable, resonant cavity device comprising:

a device vacuum envelope enclosing a sealed vacuum chamber;

a resonant cavity located within said device vacuum envelope;

tuning means for altering the resonant frequency of said cavity comprising a first deformable assembly for transmitting motion through said device vacuum envelope, tuning plunger means positioned in said device vacuum envelope and coupled to said first deformable assembly, actuating means positioned outside said device vacuum envelope for moving said tuning plunger means, tuning shaft means coupled between said actuating means and said first deformable assembly, and compensation means positioned outside and not in fluid connection with said device vacuum envelope and operative to exert a force on said tuning shaft means which opposes the force thereon resulting from atmospheric pressure upon said first deformable assembly, said compensation means comprising a compensation vacuum envelope and a second deformable assembly coupled between said compensation vacuum envelope and said tuning shaft means so as to vary the volume of said compensation vacuum envelope in response to movement of said tuning shaft means.

2. The device as defined in claim 1 wherein said first deformable assembly includes a first movable member and a first bellows having one end sealed around an opening in said device vacuum envelope and the other end sealed around a prescribed area of said first movable member.

3. The device as defined in claim 2 wherein said second deformable assembly includes a second movable member and a second bellows having one end sealed around an opening in said compensation vacuum envelope and the other end sealed around a prescribed area of said second movable member.

4. The device as defined in claim 1 wherein the force exerted on said tuning shaft means by said compensation means is equal in magnitude and opposite in direction to the force thereon resulting from atmospheric pressure upon said first deformable assembly.

5. The device as defined in claim 3 wherein said prescribed area of said first movable member is substantially equal to said prescribed area of said second movable member.

6. The device as defined in claim 5 wherein said first bellows and said second bellows are generally cylindrical and have substantially equal diameters and spring rates.

7. The device as defined in claim 6 wherein said first bellows and said second bellows are coaxially positioned at opposite ends of said tuning shaft means so that one of said bellows expands and the other of said bellows is compressed during operation of said tuning means.

8. A tunable, crossed field electron discharge device comprising:

cathode means including a cathode for generating a stream of electrons;

a device vacuum envelope for maintaining a vacuum about said stream;

microwave circuit means for supporting electromagnetic fields in interactive relationship with said stream of electrons;

means for coupling electromagnetic wave energy from said circuit means;

means for applying an electric field between said cathode means and said circuit means;

means for applying a magnetic field perpendicular to said electric field in the region of said stream;

tuning means for altering the resonant frequency of said device comprising a first bellows assembly for transmitting motion through said device vacuum envelope, tuning plunger means positioned in said device vacuum envelope and coupled to said first bellows assembly, actuating means positioned outside said device vacuum envelope for moving said tuning plunger means, tuning shaft means coupled between said actuating means and said first bellows assembly, and compensation means positioned outside and not in fluid connection with said device vacuum envelope and operative to exert a force on said tuning shaft means which opposes the force thereon resulting from atmospheric pressure upon said first bellows assembly, said compensation means comprising a compensation vacuum envelope and a second bellows assembly sealed to said compensation vacuum envelope and coupled to said tuning shaft means so as to vary the volume of said compensation vacuum envelope in response to movement of said tuning shaft means.

9. The device as defined in claim 8 wherein said first bellows assembly includes a first movable member and a first bellows having one end sealed around an opening in said device vacuum envelope and the other end sealed around a prescribed area of said first movable member.

10. The device as defined in claim 9 wherein said second bellows assembly includes a second movable member and a second bellows having one end sealed around an opening in said compensation vacuum envelope and the other end sealed around a prescribed area of said second movable member.

11. The device as defined in claim 8 wherein the force exerted on said tuning shaft means by said compensation means is equal in magnitude and opposite in direction to the force thereon resulting from atmospheric pressure upon said first bellows assembly.

12. The device as defined in claim 10 wherein said prescribed area of said first movable member is substantially equal to said prescribed area of said second movable member.

13. The device as defined in claim 12 wherein said first bellows and said second bellows are generally cylindrical and have substantially equal diameters and spring rates.

14. The device as defined in claim 13 wherein said first bellows and said second bellows are coaxially positioned at opposite ends of said tuning shaft means.

15. The device as defined in claim 14 wherein the one end of said first bellows is sealed around the inside edge of said opening in said device vacuum envelope and the one end of said second bellows is sealed around the inside edge of said opening in said compensation vacuum envelope such that one of said bellows expands and the other of said bellows is compressed during operation of said tuning means.

16. The device as defined in claim 8 wherein said device is a coaxial magnetron, wherein said microwave circuit means includes an annular stabilizing cavity and wherein said tuning plunger means includes an annular portion positioned in said stabilizing cavity.

17. The device as defined in claim 16 wherein said actuating means includes a coil associated with said tuning shaft means and a fixed position linear motor operative to electromagnetically actuate said tuning means.

18. The device as defined in claim 10 wherein said tuning means further includes a linear variable differential transformer positioned coaxially with respect to said tuning shaft means and operative to provide an output signal representative of the instantaneous resonant frequency of said device.

19. The device as defined in claim 10 wherein said tuning means further includes a linear velocity transducer positioned coaxially with respect to said tuning shaft means and operative to provide an output representative of the rate of change of the resonant frequency of said device.

20. A tunable resonant cavity device comprising:

a resonant cavity device including a vacuum envelope for maintaining a vacuum therein; and tuning means for altering the resonant frequency of said cavity comprising a first bellows assembly for transmitting motion to the interior of said vacuum envelope, a tuning plunger positioned in said vacuum envelope and coupled to said first bellows assembly, actuating means positioned outside said vacuum envelope for moving said tuning plunger, a tuning shaft coupled between said actuating means and said first bellows assembly, and pressure compensation means positioned wholly outside and not in fluid connection with said vacuum envelope for exerting a force on said tuning shaft which opposes the force thereon resulting from atmospheric pressure upon said first bellows assembly.

21. The tunable resonant cavity device as defined in claim 20 wherein said pressure compensation means comprises a vacuum enclosure and a second bellows assembly sealed to said enclosure and coupled to said tuning shaft.

22. The tunable resonant cavity device as defined in claim 21 wherein said first bellows assembly and said second bellows assembly are coaxially positioned at opposite ends of said tuning shaft.

23. The tunable resonant cavity device as defined in claim 22 wherein the total volume included within said vacuum envelope of said resonant cavity device and said vacuum enclosure of said pressure compensation means remains substantially constant during movement of said tuning shaft.

24. The tunable resonant cavity device as defined in claim 23 wherein said device is a coaxial magnetron.

* * * * *